US009272755B2

(12) United States Patent
Jain et al.

(10) Patent No.: US 9,272,755 B2
(45) Date of Patent: Mar. 1, 2016

(54) SYSTEM FOR COUPLING TWO FLOATING STRUCTURES

(71) Applicant: Keppel Offshore & Marine Technology Centre Pte Ltd, Singapore (SG)

(72) Inventors: Amit Jain, Singapore (SG); Anis Altaf Hussain, Singapore (SG); Aziz Amirali Merchant, Singapore (SG)

(73) Assignee: Keppel Offshore & Marine Technology Centre Pte. Ltd, Singapore (SG)

( * ) Notice: Subject to any disclaimer, the term of this patent is extended or adjusted under 35 U.S.C. 154(b) by 0 days.

(21) Appl. No.: 14/111,585

(22) PCT Filed: Feb. 27, 2013

(86) PCT No.: PCT/SG2013/000079

§ 371 (c)(1),
(2) Date: Oct. 14, 2013

(87) PCT Pub. No.: WO2014/112947

PCT Pub. Date: Jul. 24, 2014

(65) Prior Publication Data

US 2015/0307159 A1 Oct. 29, 2015

(30) Foreign Application Priority Data

Jan. 21, 2013 (SG) ..... 201300504-6

(51) Int. Cl.
*B63B 21/00* (2006.01)
*B63B 35/44* (2006.01)

(52) U.S. Cl.
CPC ..... *B63B 21/00* (2013.01); *B63B 35/4413* (2013.01); *B63B 2021/002* (2013.01); *B63B 2021/004* (2013.01)

(58) Field of Classification Search
CPC ..... B63B 35/4413; B63B 21/00
USPC ..... 114/230.1, 0.15, 0.17
See application file for complete search history.

(56) References Cited

U.S. PATENT DOCUMENTS 3,572,408 A * 3/1971 Hnot ..... B63B 22/023 114/230.13
4,406,636 A * 9/1983 Van Heijst ..... B63B 27/24 114/230.1
4,686,926 A * 8/1987 Vance ..... B63B 21/00 114/219
4,751,892 A * 6/1988 Sechel ..... B63B 21/00 114/221 R
4,977,846 A * 12/1990 Landa ..... B63B 21/00 114/230.17
5,365,871 A * 11/1994 Whitehead ..... A01K 87/00 114/218
5,529,521 A * 6/1996 Breivik ..... B63B 22/026 114/230.1
5,575,234 A * 11/1996 Dysarz ..... B63B 21/00 114/218

(Continued)

OTHER PUBLICATIONS

International Search Report of the International Searching Authority mailed on Jun. 19, 2013, issued in connection with International Application No. PCT/SG2013/000079 (4 pages).

(Continued)

*Primary Examiner* — Lars A Olson
*Assistant Examiner* — Jovon Hayes
(74) *Attorney, Agent, or Firm* — McCarter & English, LLP

(57) ABSTRACT

The present invention relates to a coupling system for coupling two floating structures together. The coupling system is able to accommodate the relative rotational and translation motions between the two floating structures without becoming disconnected. Furthermore, the coupling system has an engagement and disengagement mechanism that may be implemented remotely and efficiently.

25 Claims, 13 Drawing Sheets

(56) References Cited

U.S. PATENT DOCUMENTS

| | | | | |
|---|---|---|---|---|
| 6,409,431 | B1 * | 6/2002 | Lynch | B63C 1/02 114/263 |
| 6,561,113 | B2 * | 5/2003 | Leise | B63B 21/00 114/221 R |
| 6,955,134 | B2 * | 10/2005 | Prins | B63B 21/00 114/230.14 |
| 6,962,122 | B1 * | 11/2005 | Bouldin, Jr. | B63B 21/00 114/230.17 |
| 7,637,222 | B1 * | 12/2009 | Keely | B63B 21/00 114/230.1 |
| 7,673,578 | B1 * | 3/2010 | Shanahan, III | B63B 21/00 114/221 R |
| 7,784,418 | B2 * | 8/2010 | Hall | B63B 21/00 114/230.18 |
| 7,789,033 | B2 * | 9/2010 | Doig | B63B 21/00 114/230.15 |
| 9,115,777 | B2 * | 8/2015 | Campbell | F16F 1/128 |
| 2005/0005833 | A1 * | 1/2005 | Smart | B63B 21/00 114/230.17 |

OTHER PUBLICATIONS

Written Opinion mailed on Jun. 19, 2013, issued in connection with International Application No. PCT/SG2013/000079 (4 pages).

* cited by examiner

SYSTEM FOR COUPLING TWO FLOATING STRUCTURES

RELATED APPLICATIONS

This application is a U.S. National Phase Application under 35 U.S.C. 371 of International Application No. PCT/SG2013/000079 filed Feb. 27, 2013, which claims the benefit of Singapore Patent Application No. 201300504-6 filed on Jan. 21, 2013. The disclosures of these applications are incorporated herein by reference in their entireties.

FIELD OF THE INVENTION

This invention relates to a system for coupling a first floating structure to a second floating structure. More particularly, this invention relates to a system having a plurality of joints and a plurality of arms whereby the combination of joints and arms are used to couple a first floating structure to a second floating structure, which is kept in position by its own deep sea mooring system, even in harsh ocean conditions. The coupling system also provides for the quick decoupling of these two floating structures.

PRIOR ART

Floating structures such as offshore well drilling platforms have been widely used by oil-drilling companies over the past few decades. Relatively smaller floating structures such as floating tender assist drilling units are usually moored to such drilling platforms to assist in the drilling and production operations. The use of such tender drilling units provide a major economic benefit in that other systems such as the mud systems, power, pipe deck, accommodation, and so on, may be contained on the tender drilling unit and not on the drilling platform, thereby freeing up valuable space on the drilling platform and negating the need for an integrated drilling platform. Such units typically act as a platform for supplies and are usually stationed alongside a main drilling platform.

The drilling platforms are typically held in place using mooring systems that utilize combinations of wire ropes, polyester ropes or chains during the drilling and/or oil production processes. Tender assist drilling units are usually moored next to the drilling platforms and coupled to the drilling platform using nylon hawser ropes. These two floating structures are coupled together to restrict the relative movement between these two structures to facilitate the transfer of equipment or personnel. The nylon hawser rope system allows the relative distance between the two structures to be maintained within predetermined limits. However, the nylon hawser rope system does not prevent both floating structures from colliding. The nylon hawser rope system only prevents the floating structures from drifting too far apart. When faced with harsh environmental conditions, such as hurricanes, or stormy conditions, the distance between the two floating structures may be increased while maintaining the linkage between the two structures by simply increasing the length of the rope. Typically, a safe stand-off distance about 150-200 meters needs to be maintained between the tender assist drilling unit and the main drilling platform. Under such rough sea conditions, it is a requirement that the coupling system has relatively low stiffness to ensure that the coupling of the rotational and translational motions between the two floating structures is minimized. Under even further extreme weather conditions, the nylon rope coupling the two floating structures may even need to be abruptly disconnected in order to prevent both structures from capsizing.

A system for restraining an offshore drilling vessel temporarily to a drilling platform is described in U.S. Pat. No. 5,423,632 as published on 13 Jun. 1995 in the name of Anders G. C. Ekvall et al. In the disclosed system, the offshore drilling vessel is provided with a plurality of engaging members such as keys. These engaging members which extend outwardly of the drilling vessel are hingedly connected to the drilling vessels in such a manner that these engaging members are able to pivot about a horizontal plane of the hinges and pivot along a vertical plane of the hinges. The vertical pivoting motion of the engaging members allows the engaging members to engage with vertical sliding tracks disposed along the sides of the drilling platform thereby restraining the drilling vessel to the drilling platform when engaged. In operation, the drilling vessel will be guided towards the drilling platform either through the use of guide lines or the drilling vessel may be driven carefully towards the drilling platform. The drilling vessel then aligns each of the engaging members with each of the sliding tracks on the drilling platform. Once aligned, the engaging members will slide into position thereby restraining the drilling vessel to the drilling platform. The hinges on the engaging member allows for the vertical and horizontal movement of the drilling vessel relative to the drilling platform thereby compensating for some of the movements caused by the waves. However, under harsh sea conditions, the rougher waves may cause the drilling vessel to pitch, yaw, and roll relative to the drilling platform. Under such conditions, the engaging members would have to be rapidly disengaged and the two floating structures would have to be separated to a safe distance in order to prevent both structures from capsizing.

Another system for lashing a tender assist drilling unit to a floating production platform is disclosed in U.S. Pat. No. 7,383,784 as published on 10 Jun. 2008 in the name of Terje W. Eilertsen. The lashing system disclosed in this publication comprises a plurality of winches on the forward end of the tender assist drilling unit, a plurality of sheaves on the upper portion of the hull of the platform, a plurality of connection devices on the lower portion of the hull of the platform and a set of lashing lines. A lashing line extends from one of the winches, through a corresponding one of the sheaves, and vertically down alongside the platform hull to a corresponding one of the connection devices. In use, the winches reel in and pay out the lashing lines to control the separation distance between the two floating vessels. Under calm sea conditions, the lines would be shortened, and under rough sea conditions, the lines would be lengthened allowing the two structures to reach a safe separation distance.

Yet another lashing system for connecting a semisubmersible tender to a deep draft caisson vessel is disclosed in U.S. Pat. No. 6,619,223 as published on 16 Sep. 2003 in the name of Christopher Louis Beato. This publication discloses of a system that uses winches, connectors, and hawser winches. The winches are disposed on the tender and the connectors are disposed on the deep draft vessel. Hawsers constructed of a polyamide material such as nylon pass through the winches on the tender and also through the connectors on the deep draft vessel. The separation distance between the tender and the deep draft vessel may be shortened or increased by either shortening or lengthening the hawser length accordingly.

A connecting apparatus for connecting two offshore units is disclosed in PCT Application No. PCT/NL2005/00156 as published on 22 Sep. 2005 in the name of Marine Structure Consultants (MSC) B.V. The connecting apparatus disclosed in this publication comprises resetting facilities disposed on a first offshore unit for compensating the movements between the two offshore units and a coupling element for coupling the two offshore units together. The coupling element includes a frame that is attached to each offshore unit using a set of coupling means that allows pivotal and rotational movement. This means that the each offshore unit is able to pivot and rotate relative to the frame. The resetting facilities comprises of resilient elements that are connected to an offshore unit. The frame's coupling elements are then connected to these resilient elements. When an offshore unit is brought further away from the other unit by the ocean, the resilient elements will stretch and extend, allowing the other offshore unit to drift away. When the condition of the ocean becomes calm again, the resilient element would revert to its original condition, returning the two offshore units back to their original separation distance.

The abovementioned documents disclose systems and devices for temporarily connecting or coupling two offshore vessels together. However, these systems do not allow for the vessel to be rapidly disconnected in the event of worsening weather conditions. In systems that employ hawsers made of nylon, these hawsers would have to be quickly released from their winches or worse, cut into two to allow the offshore vessels to float away to safer distances. Furthermore, most of these systems which utilize hawsers, connectors and winches usually do not have a mechanism in place that prevents both offshore vessels from colliding. Some of the disclosed systems also employ overly complicated connecting or coupling mechanisms whereby both offshore vessels may only be coupled together under calm sea conditions.

SUMMARY OF INVENTION

The above and other problems in the art are solved and an advance in the art is made in accordance with this invention. In accordance with a first aspect of the invention, there is provided a system for coupling a first floating structure to a second floating structure. The system has a receiving member that is disposed on the first floating structure for receiving an engaging member. When the engaging member has received the receiving member, these two members will engage together when the receiving member moves relative to the engaging member. The system also has a first joint that is connected to the engaging member and a first arm having a first end and second end wherein the first end is operatively coupled to the first joint. The first joint is configured such that the engaging member may move along planes that are normal to the longitudinal axis of the first arm. The system also has a second joint that is operatively coupled to the second end of the first arm and a second arm having a first end and a second end, wherein the first end is operatively to the second joint. The second joint is configured such that the second arm is movable along planes that are normal to the longitudinal axis of the second joint. The system also has a coupling apparatus disposed on the second floating structure for coupling to the second end of the second arm. This system allows for two floating structures to be easily coupled together using a receiving member that engages with a receiving member when the receiving member moves relative to the engaging member. This also means that the coupling between these two floating structures may be easily disconnected by reversing the movement carried out to engage the receiving member to the engaging member. Furthermore, as the engaging member is only configured to move along planes that are normal to the longitudinal axis of the first arm, any unintentional movement by the engaging arm will not cause the receiving member to disengage from the receiving member once these two members have engaged. The rigid coupling arms also ensure that the two floating structures maintain a minimum stand-off distance and do not collide with one another.

Preferably, the coupling apparatus further comprises a third joint that is operatively coupled to the second end of the second arm and a third arm that has a first end and a second end. The first end of the third arm has a protrusion that extends into the third joint, operatively coupling the third arm to the third joint. The third joint is also configured such that the third arm is rotatable about the longitudinal axis of the third arm. The rotational movement of the third arm combined with the movement of the second arm along planes that are normal to the longitudinal axis of the second joint allows for the system to compensate for the heave, pitch, roll, yaw and sway from large waves. Unlike systems that utilize hawsers, this system is able to maintain both floating structures at a safe distance while being able to absorb the random movements brought about by the ocean's waves. In accordance with a further embodiment of this invention, the third joint is further configured such that the third joint is movable along planes that are normal to the longitudinal axes of the second arm.

In accordance with another embodiment of this invention, the coupling apparatus further comprises a third joint operatively coupled to the second end of the second arm and a third arm that has a first end and a second end. The first end of the third arm is operatively coupled to the third joint. The third joint is configured such that the third arm is movable along planes that are normal to the longitudinal axis of the third joint. In accordance with a further embodiment of this invention, the third joint is further configured such that the third joint is movable along planes that are normal to the longitudinal axis of the second arm.

In accordance with another embodiment of this invention, the coupling apparatus further comprises a hydraulic piston adapted to connect to the second end of the second arm and a skid assembly that is connected to the hydraulic piston. The usage of the hydraulic piston and the skid assembly allows for the distance between the two coupled floating structures to be lengthened or shortened as required. The hydraulic piston and skid assembly also absorbs the relative surge motions between the floating structures.

In accordance with yet another embodiment of this invention, the receiving member has a conical receptacle that is used to align the engaging member with the receiving member when the two floating structures are to be coupled together. This conical receptacle assists in the engagement of the receiving member with the engaging member by guiding the engaging member towards the required portion of the receiving member.

In accordance with a further embodiment of this invention, a plurality of male lugs are provided on an interior surface of the conical receptacle and a plurality of female lugs are disposed around a circumference of the engaging member. Each of the plurality of female lugs are engageable with each of the plurality of male lugs that are provided on the interior surface of the conical receptacle.

In accordance with another embodiment of this invention, the receiving member moves rotatably relative to the engaging member. This rotational movement causes the receiving member to engage with the engaging member. By reversing this rotational movement, this causes the receiving member to disengage from the engaging member.

In accordance with a further embodiment of this invention, a motor is located adjacent to the receiving member. This motor may be used to actuate the receiving member, causing the receiving member to rotate relative to the engaging member.

In accordance with yet another embodiment of this invention, the first joint comprises a first section. The first section has a first bracket that receives the first end of the first arm, a resilient material that is positioned such that the resilient material envelops the first end of the first arm and a first hook that is fixed to the first bracket to pivotably coupled the first end of the first arm to the first bracket. This means that the first arm is able to move along planes that are normal to the longitudinal axis of the first joint or the first joint is able to move along planes that are normal to the longitudinal axis of the first arm. Such a configuration does not allow for a rotational movement about the longitudinal axis of the first arm.

In accordance with yet another embodiment of this invention, the second joint comprises a first section and second section. The first section has a first bracket that receives the second end of the first arm, a first resilient material positioned in the first bracket such that the first resilient material envelops the second end of the first arm and a first hook that is fixed to the first bracket for coupling the second end of the first arm to the first bracket. The second section has a second bracket that receives the first end of the second arm, a second resilient material positioned in the second bracket such that the second resilient material envelops the first end of the second arm and a second hook that is fixed to the second bracket for coupling the first end of the second arm to the second bracket.

In accordance with yet another embodiment of this invention, the third joint comprises a first section and second section. The first section has a first bracket that receives the second end of the second arm. The second section has a second bracket that receives the first end of the third arm wherein the protrusion of that end extends through an opening in the second bracket. The protrusion engages with the opening thereby allowing the third arm to rotate about the longitudinal axis of the third arm. A resilient material is also positioned such in the second bracket that the resilient material envelops the first end of the third arm.

In accordance with yet another embodiment of this invention, the third joint comprises a first section and a second section. The first section comprises a first bracket that receives the second end of the second arm, a first resilient material positioned in the first bracket such that the first resilient material envelops the second end of the second arm and a first hook that is fixed to the second bracket for coupling the second end of the second arm to the first bracket. The second section has a second bracket that receives the first end of the third arm wherein the protrusion of that end extends through an opening in the second bracket. The protrusion engages with the opening thereby allowing the third arm to rotate about the longitudinal axis of the third arm. A second resilient material is also positioned such in the second bracket that the second resilient material envelops the first end of the third arm.

In accordance with yet another embodiment of this invention, the third joint comprises a first section and a second section. The first section has a first bracket that receives the second end of the second arm. The second section has a second bracket that receives the first end of the third arm, a resilient material positioned in the second bracket such that the resilient material envelops the first end of the third arm and a second hook that is fixed to the second bracket for coupling the first end of the third arm to the second bracket.

In accordance with yet another embodiment of this invention, the third joint comprises a first section and second section. The first section has a first bracket that receives the second end of the second arm, a first resilient material positioned in the first bracket such that the first resilient material envelops the second end of the second arm and a first hook that is fixed to the first bracket for coupling the second end of the second arm to the first bracket. The second section has a second bracket that receives the first end of the third arm, a second resilient material positioned in the second bracket such that the second resilient material envelops the first end of the third arm and a second hook that is fixed to the second bracket for coupling the first end of the third arm to the second bracket.

In accordance with further embodiments of this invention, the resilient material, the first resilient material and the second resilient material comprise a flexible elastomeric element.

In accordance with yet further embodiments of this invention, the hydraulic piston and the skid assembly are disposed on an extended platform on a pipe rack deck of the second floating structure.

In accordance with yet further embodiments of this invention, the hydraulic piston and the skid assembly are disposed on a main deck of the second floating structure.

In accordance with yet further embodiments of this invention, the hydraulic piston and the skid assembly are disposed in a box bottom of a main deck of the second floating structure.

BRIEF DESCRIPTION OF THE DRAWINGS

The above advantages and features of a system in accordance with this invention are described in the following detailed description and are shown in the drawings.

DETAILED DESCRIPTION

This invention relates to a system for coupling a first floating structure to a second floating structure. More particularly, this invention relates to a system having a plurality of joints and a plurality of arms whereby the combination of joints and arms are used to couple a first floating structure to a second floating structure. The coupling system also provides for the quick decoupling of two floating structures. Furthermore, the coupling system accommodates for the movement of the first floating structure relative to the second floating structure.

The floating structures that may be coupled together using this invention may include, but are not limited to, tender assist drilling units, oil wellhead platforms, oil production platforms and most types of semi-submersible platforms. One skilled in the art will recognize that this invention may be used to couple any two floating vessels or floating structures together and to maintain the two floating structures at a predetermined distance. Typically, the separation distances between the two floating structures are between 15 meters-20 meters.

Figure 1:
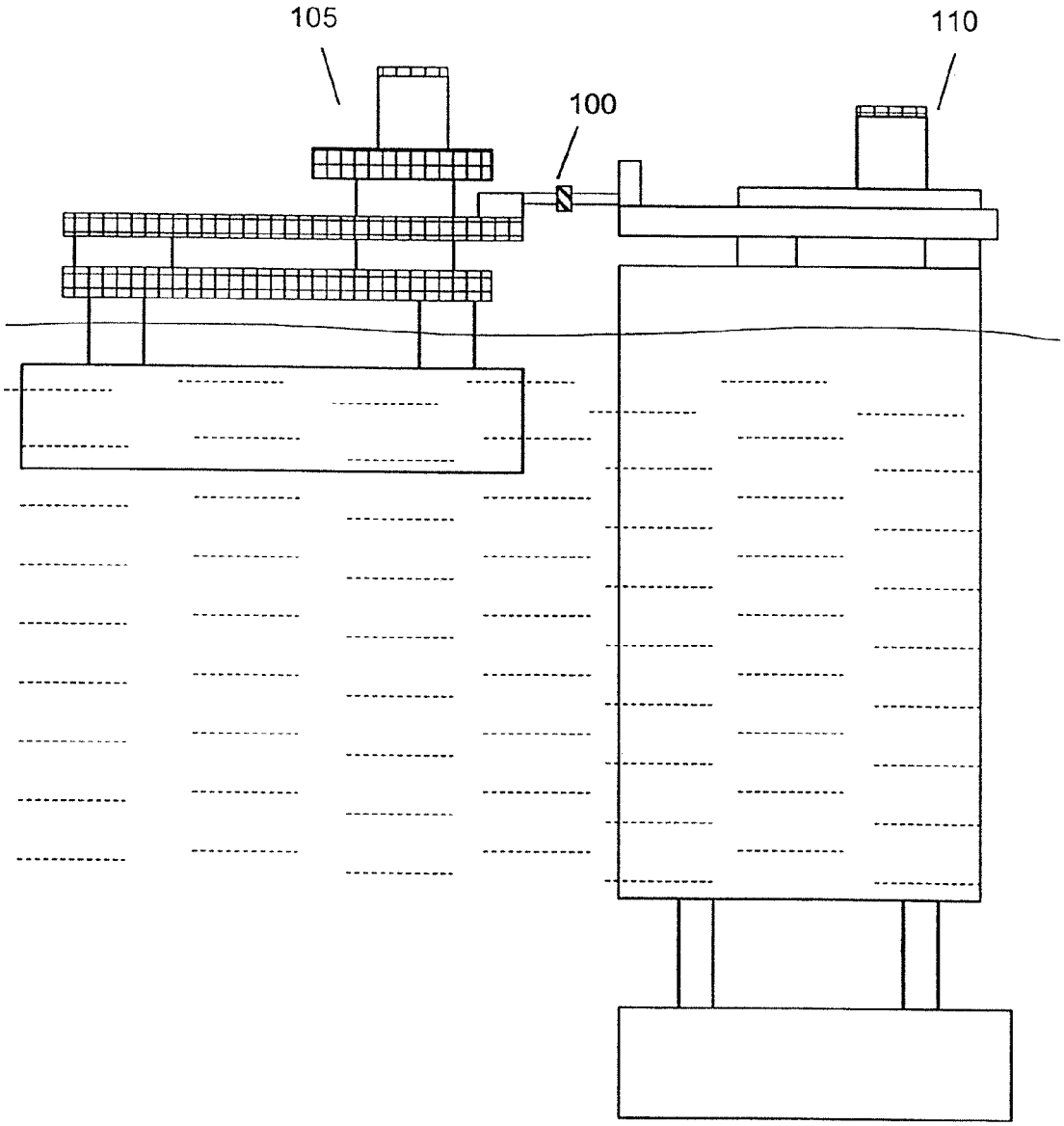
FIG. 1 illustrating a tension leg platform coupled to a tender assist drilling platform using a coupling system in accordance with an embodiment of this invention.

FIG. 1 illustrates a tender assist drilling platform 105 being coupled to a tension leg platform 110 using coupling system 100 in accordance with an embodiment of this invention. Coupling system 100 ensures that tender assist drilling platform 105 remains at a safe distance away from tension leg platform 110. Coupling system 100 utilizes a combination of rigid arms that are connected using bendable and rotatable joints. The rigid arms prevent the two floating structures from colliding while the bendable and rotatable joints allow coupling system 100 to compensate for the pitch, heave, roll, sway and yaw of the two floating structures relative to one another. Tender assist drilling platform 105 and tension leg platform 110 therefore may move independently of one another. Under extreme weather conditions, coupling system 100 will disengage allowing tender assist drilling platform 105 to drift away from tension leg platform 110, preventing these two floating structures from colliding in case of mooring failures of the two floating structures. The detailed workings of the various components in coupling system 100 are illustrated in detail in FIGS. 2-11 and in the following paragraphs.

Figure 2:
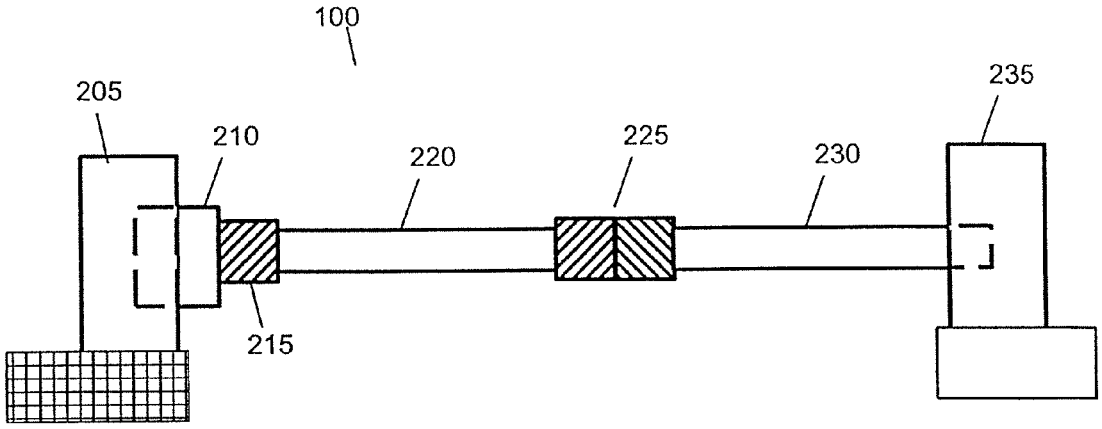
FIG. 2 illustrating a side view of the coupling system in accordance with an embodiment of this invention.

FIG. 2 illustrates a side view of an embodiment of coupling system 100. In this embodiment, coupling system 100 has engaging member 210 that is connected to first joint 215. One end of arm 220 is operatively coupled to first joint 215 and the other end of arm 220 is operatively coupled to second joint 225. Second joint 225 is also operatively coupled to arm 230. Coupling system 100 also has coupling apparatus 235 that may be disposed on tender assist drilling platform 105. In certain embodiments of the invention, coupling apparatus 235 may be housed on an extended platform on the pipe rack deck of tender assist drilling platform 105. This position is selected so that coupling apparatus 235 does not interfere with any of the equipment and structures on the deck. In another embodiment of the invention, coupling apparatus 235 is located on the main deck, which is structurally stronger than the pipe rack deck. In yet another embodiment of the invention, coupling apparatus 235 is located inside the box bottom of the main deck. One skilled in the art will recognize that coupling apparatus 235 may be positioned at various locations at tender assist drilling platform 105 without departing from this invention.

Coupling apparatus 235 is connected to the other end of arm 230 as shown in FIG. 2. Coupling system 100 also comprises receiving member 205 that is disposed on tension leg platform 110 for receiving engaging member 210. Engaging member 210 will engage with receiving member 205 when tender assist drilling platform 105 is to be coupled together with tension leg platform 110. One skilled in the art will recognize that the positions of coupling apparatus 235 and receiving member 205 may be varied without departing from this invention, that is, coupling apparatus 235 may be positioned at various locations at tension leg platform 110 and that receiving member 205 may be positioned at tender assist drilling platform 105.

Figure 3A:
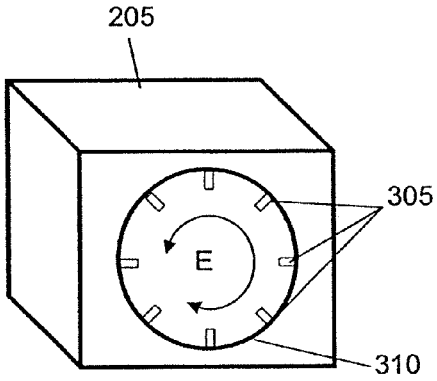
FIG. 3*a* illustrating a perspective view of the receiving member in accordance with an embodiment of this invention.

A perspective view of receiving member 205 is illustrated in FIG. 3A. In an embodiment of the invention, receiving member 205 may have a cavity or a receptacle that is shaped as cone for receiving engaging member 210. Cone cavity 310 is designed to be bigger than engaging member 210 so that cone cavity 310 may assist in the alignment of engaging member 210 with receiving member 205. By using cone cavity 310, engaging member 210 does not have to align precisely with the middle of cone cavity 310 before engaging member 210 is able to engage with receiving member 205. During deep sea operations, maneuvers that require precise movements and timings are often difficult, if not impossible to execute due to the unpredictable movement of the ocean's waves. When engaging member 210 is to engage with receiving member 205, engaging member 210 just has to be guided towards the general vicinity of receiving member 205. Upon contact with the inner surface of cone cavity 310, due to the tapered shape of cone cavity 310, engaging member 210 will slide towards the center of receiving member 205. Receiving member 205 will then move relative to engaging member 210 causing receiving member 205 to engage with engaging member 210. This relative movement may involve either a sliding movement or a rotational movement.

Figure 3B:
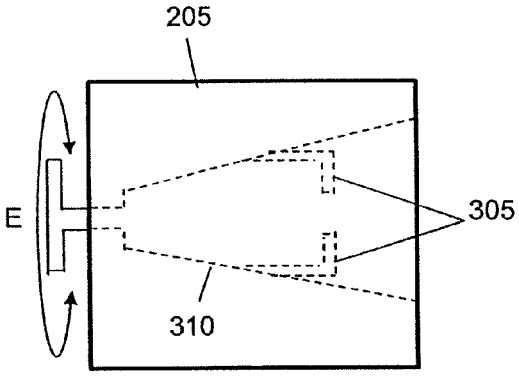
FIG. 3*b* illustrating a side cross sectional view of the receiving member in accordance with an embodiment of this invention.
Figure 4:
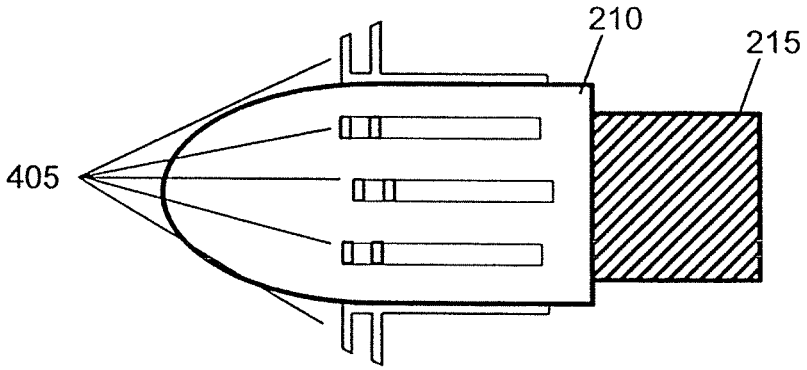
FIG. 4 illustrating a side view of an engaging member in accordance with an embodiment of this invention.

As shown in FIGS. 3*a* and 3*b*, a plurality of female lugs 305 is positioned around the inner circumference of cone cavity 310. Correspondingly, a plurality of male lugs 405 is positioned around the external circumference of engaging member 210 as shown in FIG. 4. One skilled in the art will recognize that any number of female and male lugs may be used without departing from this invention. In the embodiment shown in FIGS. 3 and 4, 8 female lugs are provided with an angular separation of 22.5 degrees in the interior of cone cavity 310 and 8 male lugs are provided on engaging member 210. After engaging member 210 has been received by receiving member 205, receiving member 205 may rotate in either direction, relative to engaging member 210, as indicated by the directions shown on arrow E, causing female lugs 305 to engage with male lugs 405. By reversing the direction of the rotational movement, this will cause female lugs 305 to disengage from male lugs 405. A steering wheel-like handle is provided at the rear of receiving member 205 to assist in the rotation of receiving member 205 either manually or through mechanical means. A motor located adjacent to receiving member 205 may be used to rotate receiving member 205. This motor may be remotely controlled allowing for the two floating structures to be rapidly disengaged or engaged as required. This means that under extreme weather conditions, the two floating structures may easily and rapidly disengage, without requiring workers to manually actuate the handle to release engaging member 210 from receiving member 205. This is advantageous as conditions on these floating structures become quite hazardous under extreme weather conditions. It would not be safe for workers on these floating structures if they had to manually handle or manipulate hawsers under these conditions. The mechanism disclosed above for coupling system 100 addresses these safety issues as the mechanism allows for the engaging and disengaging actions to be carried out remotely and efficiently.

Referring to FIG. 4, engaging member 210 is shown to have a bulbous shape. This shape was chosen as this shape may be easily guided into the receptacle in receiving member 205 by cone cavity 310. One skilled in the art will recognize that engaging member 210 may be of other shapes without departing from this invention. As shown in the cross sectional view of engaging member 210 in FIG. 5*a*, one end of first joint 215 is attached to engaging member 210 and the other end is operatively coupled to first arm 220 through bracket 505, hook 515 and opening 510. Hook 515 is fixed onto bracket 505 and passes through opening 510 in first arm 220. The connection between hook 515 and opening 510 is such that it allows first joint 215 to pivot about this connection. In other words, engaging member 210 may move along planes that are normal to the longitudinal axis of first arm 220. This freedom of movement about the pivotable connection allows engaging member 210 and first arm 215 to move in response to the relative heave, yaw, pitch and swaying motions between the two floating structures while allowing first 220 to remain rigid, maintaining the distance between the two floating structures. In an embodiment of this invention, the pivotable connection forms by hook 515 and opening 510 allows for movement of more than 15 degrees about the longitudinal axis of first arm 220. The connection between first joint 215 and first arm 220 is designed to be a pivoting motion so that first joint 215 may not rotate relative to first arm 220 and vice versa. This is to prevent the accidental rotation of engaging member 210 due to the motions of the two floating structures.

The section of first arm 220 that is contained within bracket 505 is surrounded by a resilient material. Resilient material 520 may comprise of any type of flexible elastomer that is able to compress and expand when a pressure is applied and removed. The flexible elastomer must be able to absorb heavy compressive and shear loads as well. In other words, resilient material 520 acts as a damper, damping the heaving and swaying motions of engaging member 210 by compressing and expanding.

Figure 5A:
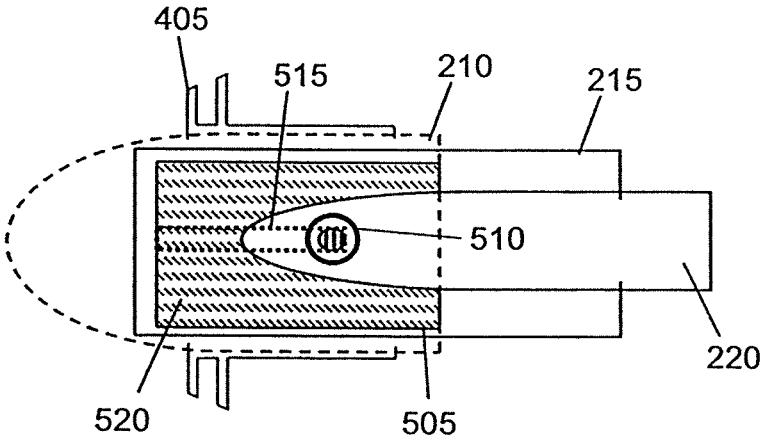
FIG. 5*a* illustrating a cross sectional view of an engaging member in accordance with an embodiment of this invention.
Figure 5B:
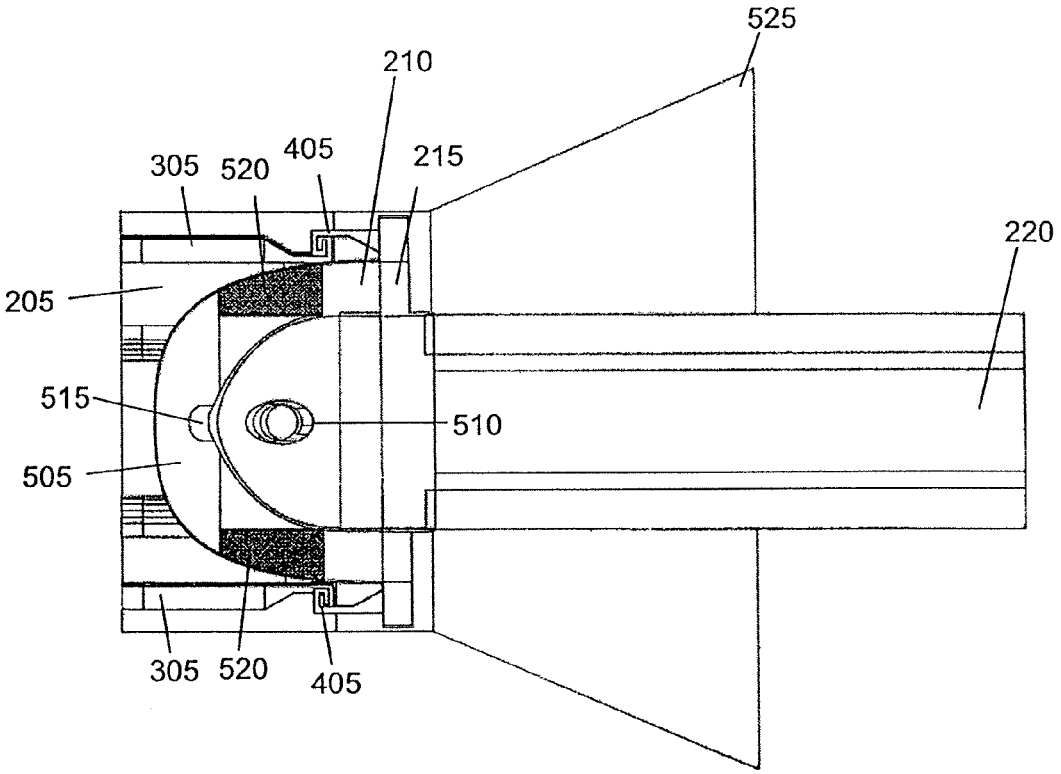
FIG. 5*b* illustrating a cross sectional view of an engaging member in that is engaged with a receiving member in accordance with an embodiment of this invention.
Figure 5C:
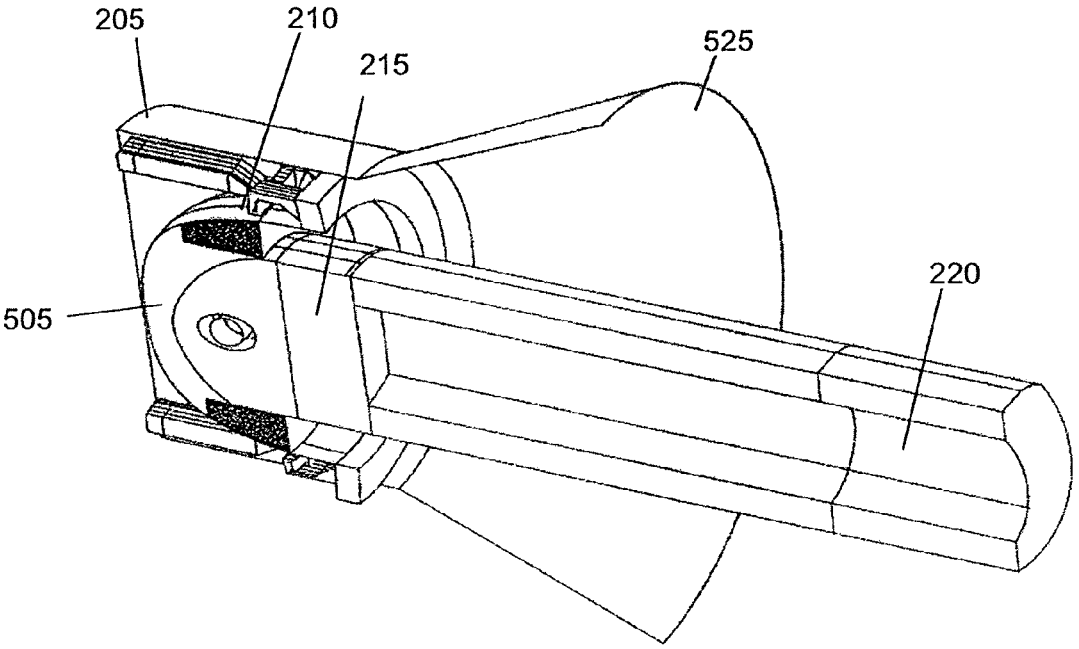
FIG. 5*c* illustrating a cross sectional perspective view of an engaging member in that is engaged with a receiving member in accordance with an embodiment of this invention.

In yet another embodiment of the invention, cone cavity 525 protrudes out of receiving member 205. The cross sectional side view of this embodiment is illustrated in FIG. 5*b*. Cone cavity 525 in this embodiment performs the same function as that previously described, which is to guide engaging member 210 towards the receptacle in receiving member 205. In FIG. 5*b*, receiving member 205 has rotated relative to engaging member 210, causing female lugs 305 to interlock or engage with male lugs 405. Likewise, female lugs 305 and male lugs 405 may be disengaged by rotating receiving member 205 in an opposing direction. FIG. 5*c* illustrates a cross sectional perspective side view of the embodiment illustrated in FIG. 5*b*.

Figure 6A:
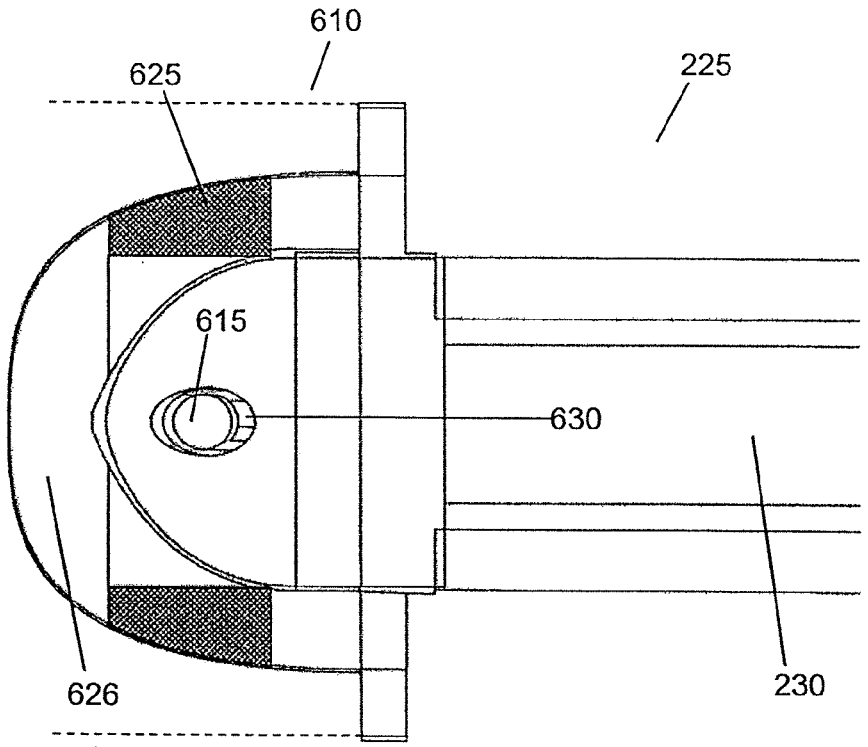
FIG. 6*a* illustrating a cross sectional view of a joint having a flexible bendable section in accordance with an embodiment of this invention.
Figure 6B:
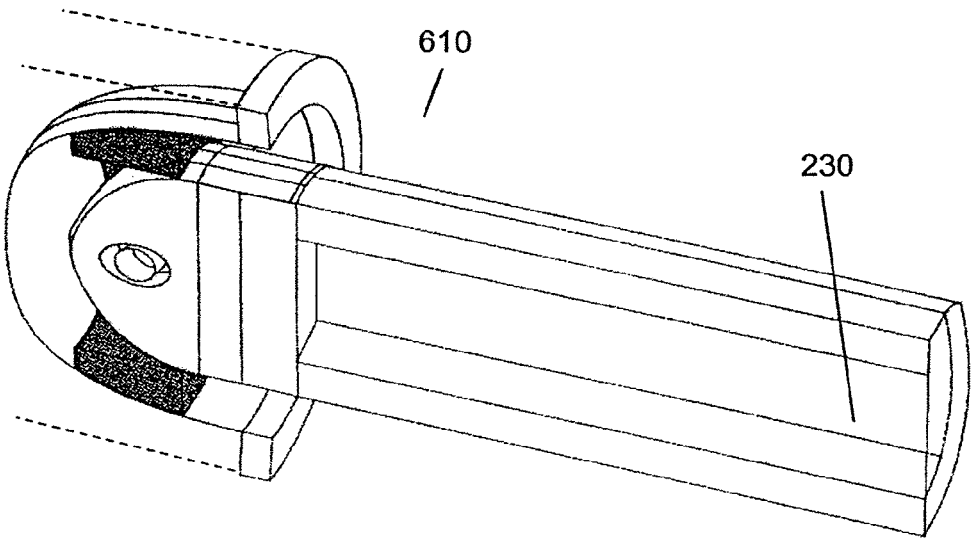
FIG. 6*b* illustrating a cross sectional perspective view of a joint having a flexible bendable section in accordance with an embodiment of this invention.
Figure 6C:
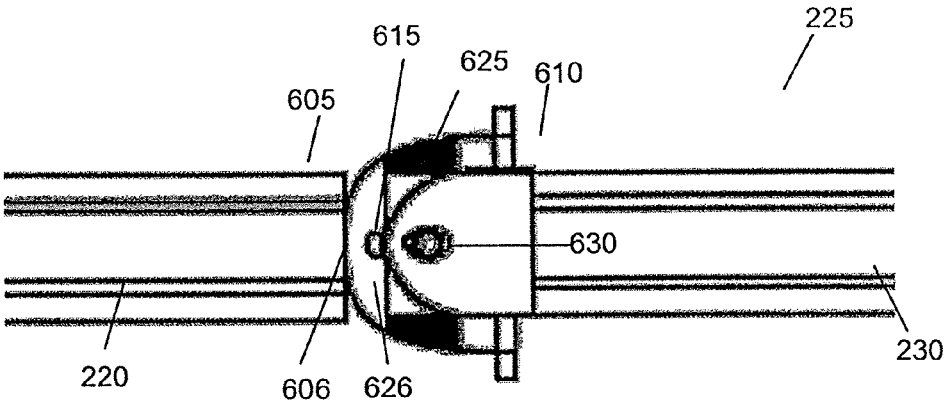
FIG. 6*c* illustrating a cross sectional view of a joint having a first section for receiving an arm and a second flexible bendable section in accordance with an embodiment of this invention.

FIG. 6*a* illustrates the cross sectional view of second joint 225. Second joint 225 may be divided into two sections, section 605 (shown in FIG. 6*c*) and section 610. Section 610 is provided with pivoting means so that arm 230 may pivot relative to second joint 225 and vice versa. In section 610, arm 230 is pivotably connected to bracket 626 through hook 615. Hook 615 is fixed onto bracket 626 and passes through opening 630 in arm 230. The connection between hook 615 and opening 630 is such that it allows arm 230 to pivot about this connection. In other words, arm 230 may move along planes that are normal to the longitudinal axis of second joint 225. As this embodiment only allows for the movement of arm 230 along planes normal to the longitudinal axis of second joint 225 or the movement of second joint 225 along planes normal to the longitudinal axis of arm 230, this ensures that engaging member 210 does not accidentally disengage due to the relative pitch, roll and yaw motions of the two floating structures. The relative translational motions of the two floating structures may be accommodated by this joint. Resilient material 625 is positioned adjacent the end of arm 230 located within bracket 626 thereby damping and absorbing the relative heave, sways and surge motions of the two floating structures. A cross sectional perspective side view of section 610 is shown in FIG. 6*b*. FIG. 6*c* illustrates a cross sectional side view of section 605 and section 610 of first joint 225. Unlike section 610, pivoting means are not provided in section 605. Instead, section 605 has bracket 606 that is used to connect an end of first arm 220 to second joint 225.

Figure 7:
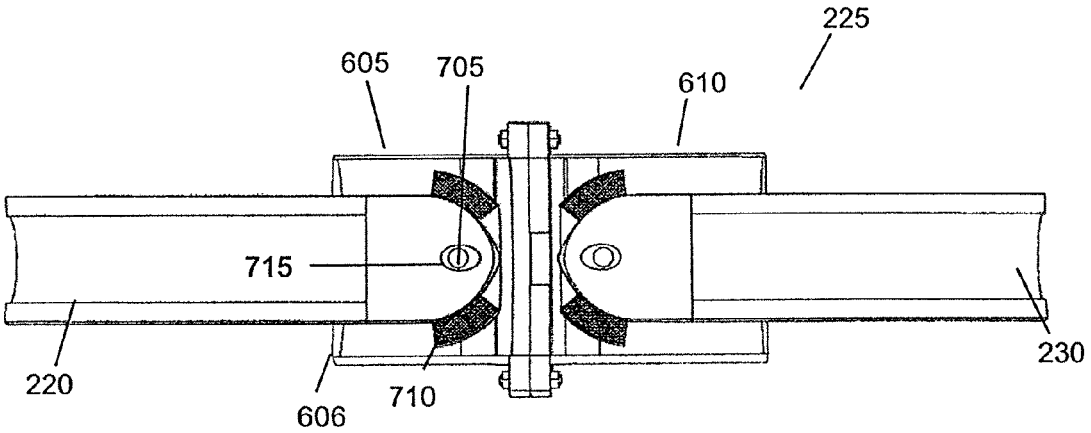
FIG. 7 illustrating a cross sectional view of a joint having a first bendable section and a second bendable section in accordance with an embodiment of this invention.

Another embodiment of second joint 225 is illustrated in FIG. 7. In this embodiment, section 605 is provided with pivoting means so that second joint 225 may pivot relative to first arm 220 and vice versa. In section 605, first arm 220 is pivotably connected to bracket 606 through hook 705. Hook 705 is fixed onto bracket 606 and passes through opening 715 in first arm 220. The connection between hook 705 and opening 715 allows first arm 220 to pivot about this connection. In other words, first arm 220 may move along planes that are normal to the longitudinal axis of second joint 225. Similarly, as this embodiment only allows for the movement of first arm 220 along planes normal to the longitudinal axis of second joint 225 or the movement of second joint 225 along planes normal to the longitudinal axis of first arm 220, this ensures that engaging member 210 may not accidentally disengage due to the motions of the two floating structures. To dampen the movement between first arm 220 and second joint 225, resilient material 710 is placed surrounding the end of first arm 220 that is located within bracket 606. This configuration dampens the relative translational movements between the two floating structures.

Figure 8A:
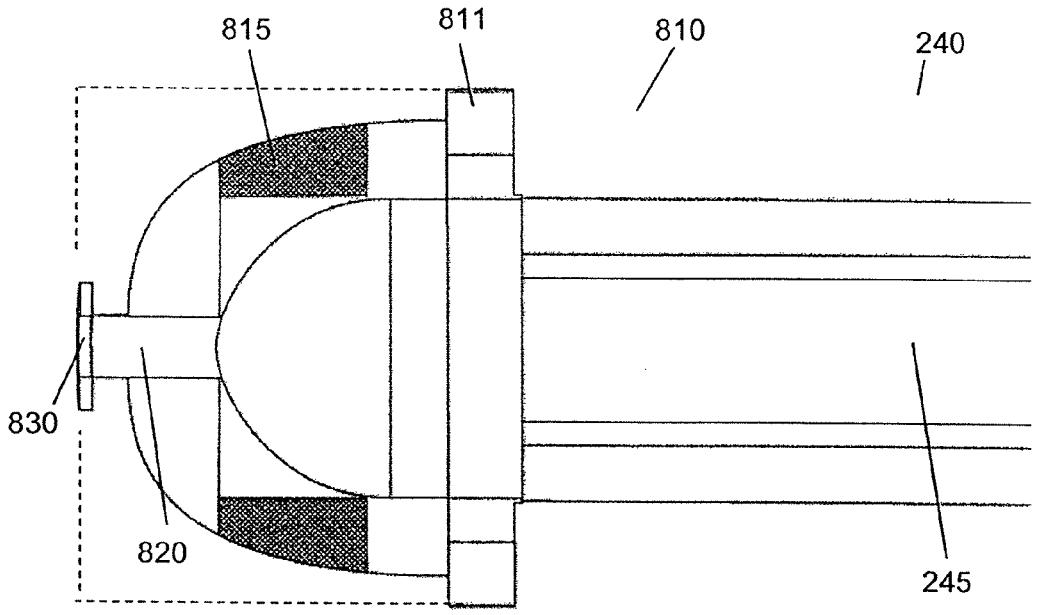
FIG. 8*a* illustrating a cross sectional view of a joint having a rotational section in accordance with an embodiment of this invention.
Figure 8B:
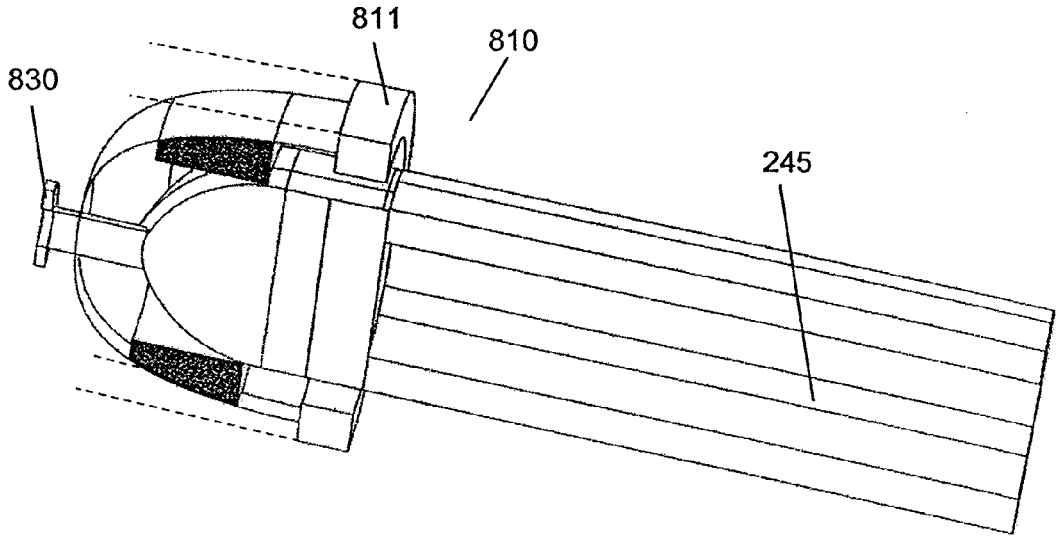
FIG. 8*b* illustrating a cross sectional perspective view of a joint having a rotational section in accordance with an embodiment of this invention.
Figure 8C:
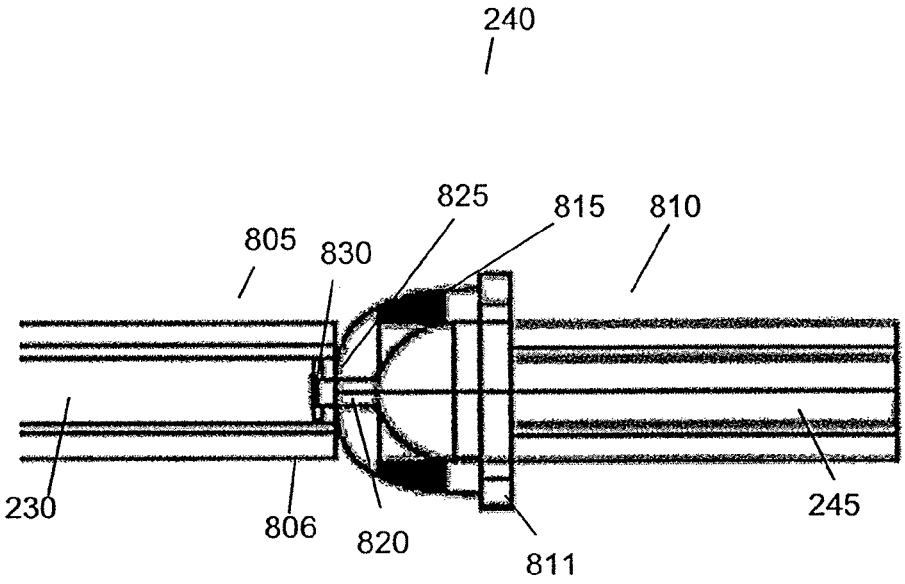
FIG. 8*c* illustrating a cross sectional view of a joint having a first section for receiving an arm and a second rotational section in accordance with an embodiment of this invention.

In other embodiments of the invention, a third joint that is connected to another that arm may be connected between arm 230 and coupling apparatus 235. This third joint in combination with this arm could be a rotatable joint-arm combination that allows the first floating structure to rotate relative to the second floating structure and vice versa. Such a joint is illustrated in FIG. 8*a*. Third joint 240 consists of two sections, section 805 (shown in FIG. 8*c*) and section 810. As shown in FIG. 8*a*, third arm 245 has protrusion 820 that extends through an opening of bracket 811. Anchor 830, which is wider than opening 825, is positioned at the end of protrusion 820. As the width or diameter of protrusion 820 is smaller than the opening at the end of bracket 811, protrusion 820 is not in contact with opening 825. Therefore, arm 245 may rotate freely about its own longitudinal axis. Anchor 830 prevents protrusion 820 from dislodging from bracket 811, maintaining the coupling between arm 24 and joint 240. Resilient material 815 is positioned adjacent the end of arm 245 located within bracket 811. Resilient material 815 acts to limit and damp the rotational movement of arm 245. In some embodiments of the invention, a dry lubricant layer may be disposed at the interface between resilient material 815 and the end of arm 245 that is in contact with resilient material 815. This dry lubricant layer minimizes the friction between these two components thereby assisting in the rotation of arm 245. In operation, the torsional oscillations would be absorbed by the resilient material. This ensures that the lifespan of the system is enhanced as the resilient element is able to accommodate all the small movements and motions better than other types of mechanical components, e.g. bearing caps. A cross sectional side perspective view of section 810 is shown in FIG. 8*b*. Sections 805 and 810 of joint 240 are shown in FIG. 8*c*. Unlike section 810, section 805 has not been provided with rotatable or pivoting means. Section 805 has bracket 806 that is used to connect to an end of arm 230. Joint 240 allows for the relative pitch, roll and yaw motions between the two floating structures to be accommodated.

Figure 9:
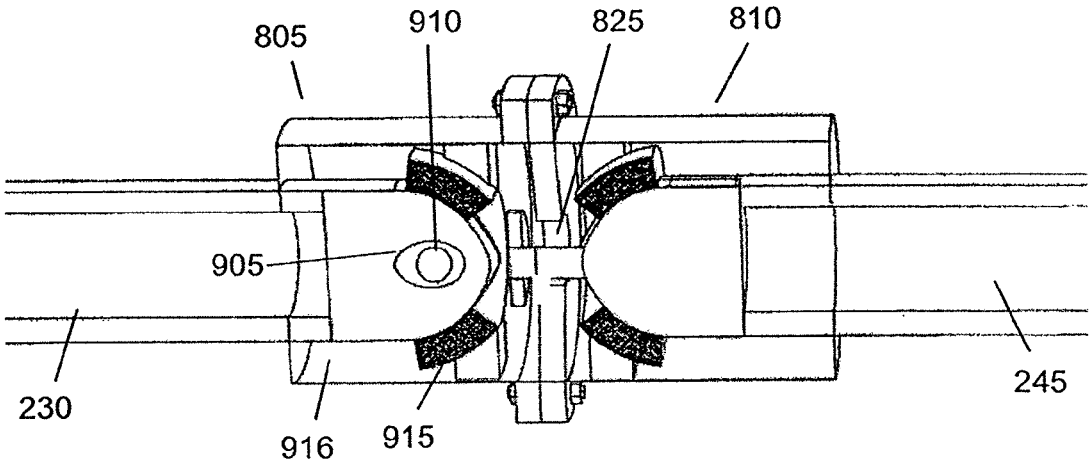
FIG. 9 illustrating a cross sectional view of a joint having a first bendable section and a second rotational section in accordance with an embodiment of this invention.

In further embodiments of the invention, section 805 is provided with pivoting means. As illustrated in FIG. 9, bracket 916 is provided with hook 910 that passes through opening 905 on arm 230. Arm 230 is pivotably connected to third joint 240 through the connection between hook 910 and opening 905. This connection thereby allows arm 230 to move along planes that are normal to the longitudinal axis of third joint 240 or allows third joint 240 to move along planes that are normal to the longitudinal axis of arm 230. The end of arm 230 positioned within bracket 916 is surrounded by resilient material 915 which acts as a damper, absorbing the motion of the arm relative to the joint. Protrusion 820 passes through opening 825 of bracket 811 into bracket 916. Anchor 830 moves freely around an hollow area in bracket 916 allowing arm 245 to rotate freely about its longitudinal axis. Not only does this embodiment allow joint 240 to accommodate for the relative rotational movements between the two floating structures, this embodiment also allows for the translational movement to be accommodated as well.

Figure 10:
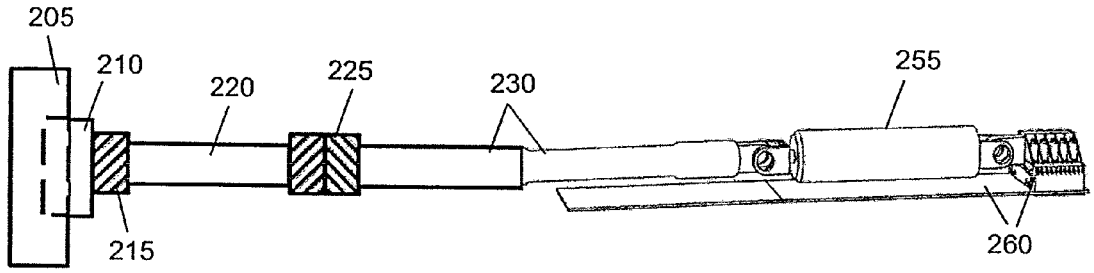
FIG. 10 illustrating a side view of the coupling system in accordance with an embodiment of this invention with the hydraulic piston and skid assembly.
Figure 11:
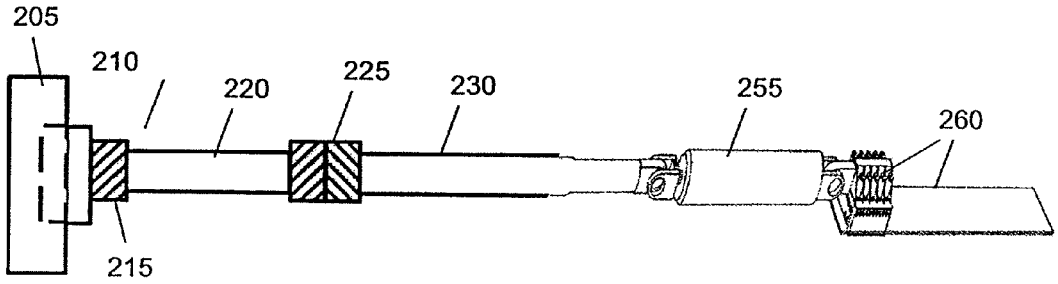
FIG. 11 illustrating a side view of the coupling system in accordance with an embodiment of this invention with the extended hydraulic piston and skid assembly.

In other embodiments of the invention, coupling apparatus 235 is replaced by hydraulic piston 255 and skid assembly 260 as illustrated in FIG. 10. In this configuration, one end of arm 230 will be connected to hydraulic piston 255 while skid assembly 260 will be positioned at a specific location on tender assist drilling platform 105 as previously discussed. Hydraulic piston 255 is powered by pressurized hydraulic fluid, such as oil. Typically, hydraulic piston 255 will have a barrel, in which a piston connected to a rod moves in and out from. When the distance between the two floating structures is to be increased, the rod will extend out of hydraulic piston 255 moving the two floating structures away from one another. When the two floating structures are to be brought closer, the rod retracts back into the hydraulic piston drawing the two structures closer together. The hydraulic piston and skid assembly also absorbs the relative surge motions between the floating structures. Furthermore, after engaging member 210 has disengaged from receiving member 205, hydraulic piston 255 will retract, causing the arm and joint system to pull away from receiving member 205. Skid assembly 260 is used to allow the separation between the two structures to be increased or decreased accordingly. Skid assembly 260 consists of tracks positioned on tender assist drilling platform 105 on which hydraulic piston 255 may slide along. In an exemplary embodiment, skid assembly 260 may consist of tracks that are 10 meters in length while hydraulic piston 255 may extend up to 5 meters. FIG. 11 illustrates an embodiment of the invention when hydraulic piston 255 is fully extended. One skilled in the art will recognize that the hydraulic piston and skid assembly configuration may be connected to the ends of either arm 230 or the end of subsequent arms, e.g. arm 245, etc., without departing from this invention.

Figure 12:
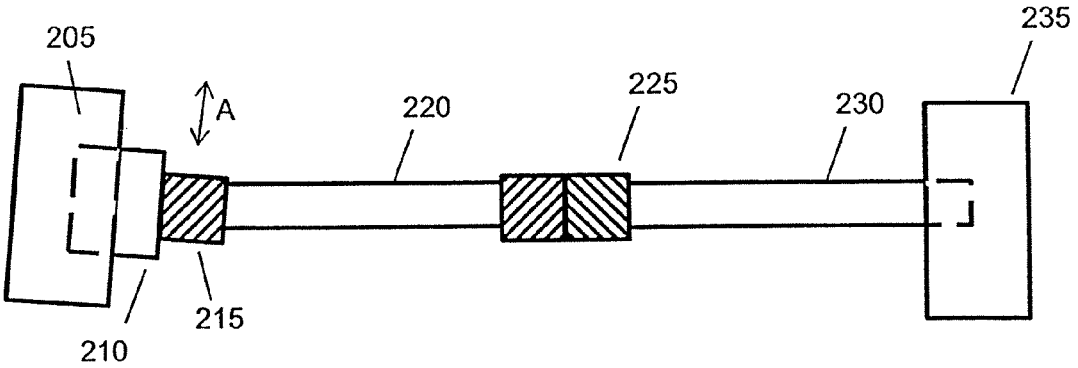
FIG. 12 illustrating a side view of the coupling system in accordance with an embodiment of this invention showing the movement of the first joint.
Figure 13:
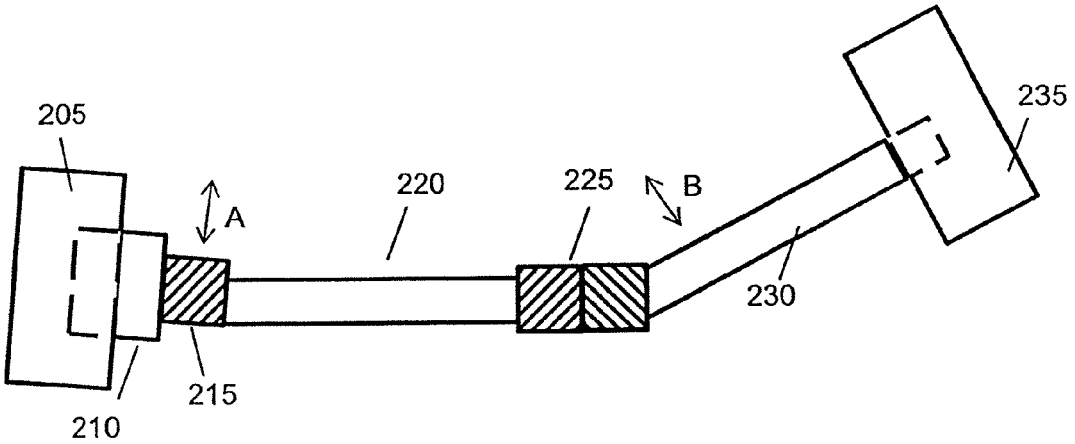
FIG. 13 illustrating a side view of the coupling system in accordance with an embodiment of this invention showing the movement of the first joint and the second arm.

The movements of the arms and joints relative to one another will be described with reference to FIGS. 12 to 17. In these drawings, it is assumed that tender assist drilling platform 105 has been successful coupled to tension leg platform 110 using an embodiment of coupling system 100. As shown in FIG. 12, engaging member 210 is connected to first joint 215. First joint 215 is provided with pivoting means that allow engaging member 210 to move along planes that are normal to the longitudinal axis of first arm 220. As an example, arrow A shows that engaging member 210 is able to move upwards, downwards, and sideways following the wave induced motions of tension leg platform 110. FIG. 13 illustrates another embodiment of the invention in which second joint 225 is provided with pivoting means at the section that is connected to arm 230. Therefore, arm 230 is now able to move along planes that are normal to the longitudinal axis of the second joint. As an example, arrow B shows that arm 230 is able to move upwards, downwards and sideways, following the motions of tension leg platform 110 in the ocean. In this embodiment, there are now two joints that are able to compensate for the relative translational movements of the two floating structures.

Figure 14:
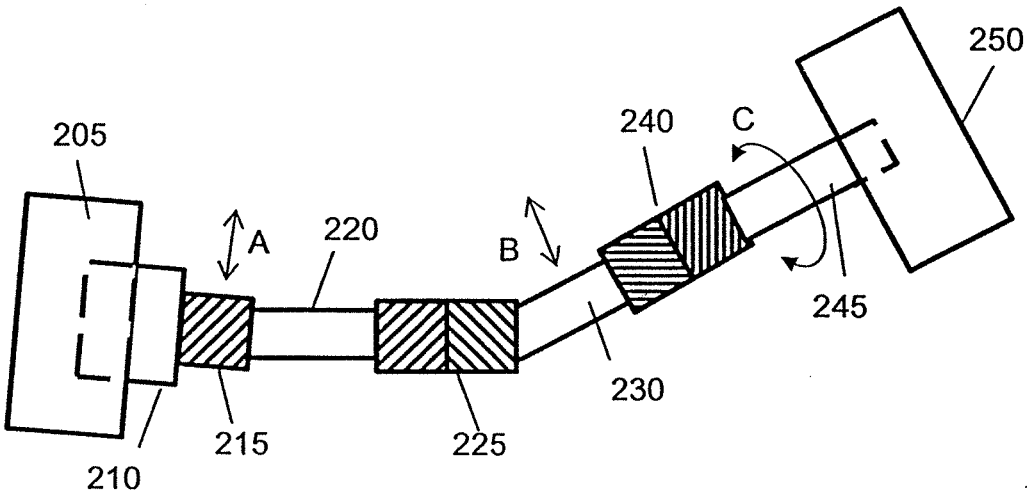
FIG. 14 illustrating a side view of the coupling system in accordance with an embodiment of this invention showing the movement of the first joint and the second arm together with the rotational movement of the third arm.
Figure 15:
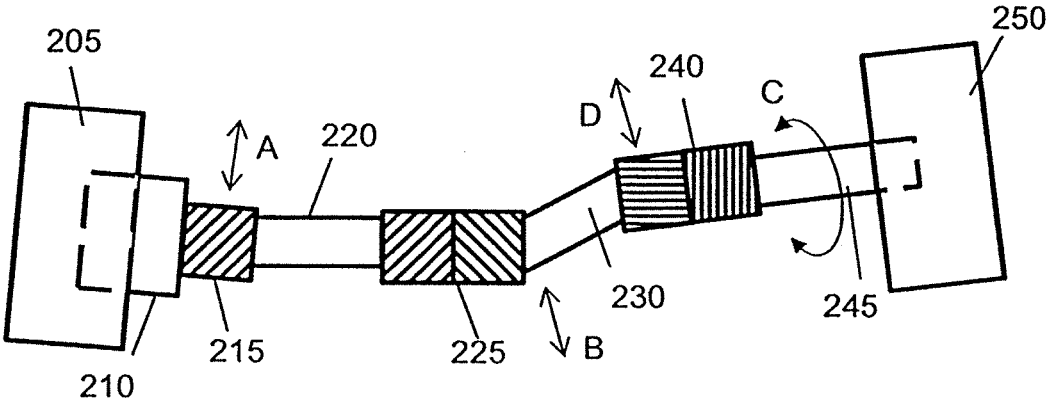
FIG. 15 illustrating a side view of the coupling system in accordance with an embodiment of this invention showing the movement of the first joint and the second arm. This figure also illustrates the movement of the first section of the third joint and the rotational movement of the third arm.

In yet another embodiment of the invention, third joint 240 is connected between arm 230 and arm 245. This embodiment is illustrated in FIG. 14. Third joint 240 is provided with rotatable means thereby allowing arm 245 to rotate about its longitudinal axis. Arrow C illustrates the rotational movement of arm 245. In this embodiment, these three joints allow for the relative translational and rotational movements of the two floating structures to be accommodated. In the embodiment shown in FIG. 15, the section of third joint 240 that is coupled to arm 230 is provided with pivoting means. Therefore, second joint 240 is now able to move along planes that are normal to the longitudinal axis of arm 230. Arrow D illustrates an exemplary direction of such a movement. In such an embodiment, the two floating structures may be heaving, pitching, swaying, surging, and rolling relative to each other and coupling system 100 would still be able to remain connected between these two structures as all the random movements would be absorbed by these three joints.

Figure 16:
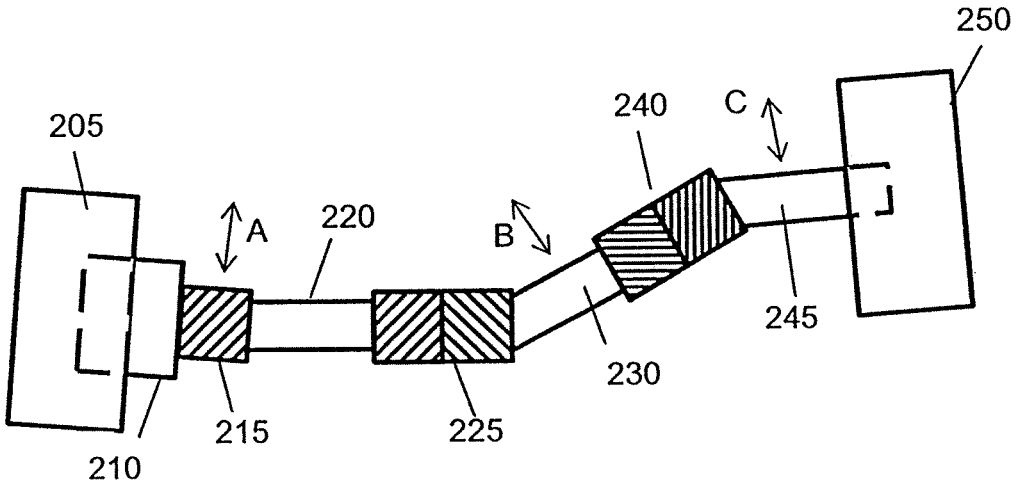
FIG. 16 illustrating a side view of the coupling system in accordance with an embodiment of this invention showing the movement of the first joint, the second arm and the third arm.
Figure 17:
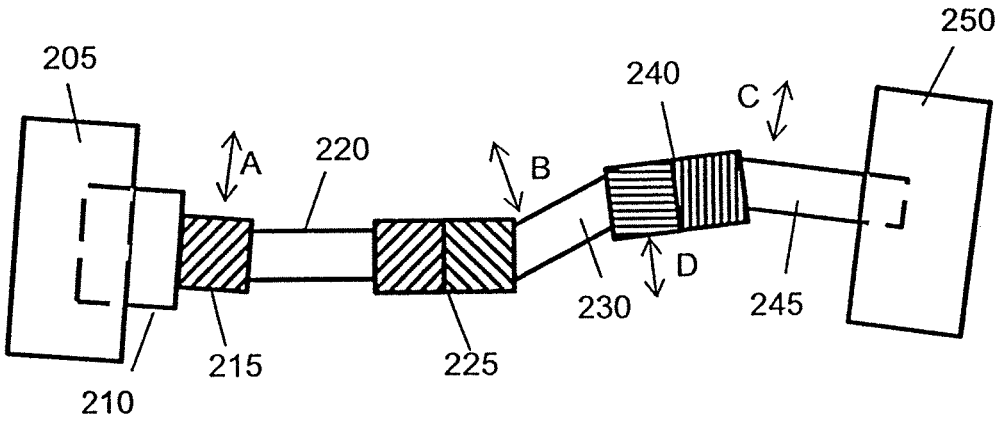
FIG. 17 illustrating a side view of the coupling system in accordance with an embodiment of this invention showing the movement of the first joint, the second arm, the third joint and the third arm.

Yet another embodiment of the invention is illustrated in FIG. 16. In this embodiment, unlike the previous embodiment, third joint 240 is provided with pivoting means instead. This means that arm 245 is able to move along planes that are normal to the longitudinal axis of third joint 240. Arrow C shows the direction of such an exemplary movement. FIG. 17 illustrates yet another embodiment of the invention whereby third joint 240 is provided with yet another pivoting means allowing third joint 240 to move along planes that are normal to the longitudinal axis of arm 230. An example of such movement is illustrated by the directions of arrow D.

Figure 18:
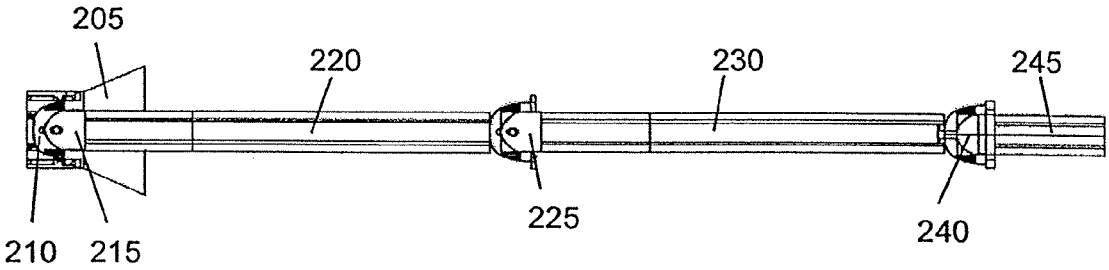
FIG. 18 illustrating a side cross sectional view of a coupling system in accordance with an embodiment of this invention.

FIG. 18 illustrates an embodiment of coupling system 100. In this embodiment, engaging member 210 has been received by receiving member 205. The lugs on the respective modules have interlocked with one another creating a stable connection. Arm 220 is connected to first joint 215 and second joint 225. First joint 215 and second joint 225 are both provided with pivoting means. Arm 230 is connected to second joint 225 and third joint 240 while arm 245 is connected to third joint 240 and to a coupling apparatus disposed on the second floating structure. Third joint 240 is provided with rotational means allowing arm 245 to rotate about its longitudinal axis. This combination of arms and joints allows this embodiment of coupling system 100 to easily accommodate the for the relative translational and rotational movements of the two floating structures while maintaining the two floating structures at safe operating distances.

The above is a description of a coupling system for coupling first floating structures to a second floating structure. It is foreseen that those skilled in the art can and will design alternative embodiments of this invention as set forth in the following claims.

The invention claimed is:

1. A system for coupling a first floating structure to a second floating structure, the system comprising:

a receiving member disposed on the first floating structure for receiving an engaging member, the engaging member adapted to engage with the receiving member when the receiving member moves relative to the engaging member;

a first joint connected to the engaging member;

a first arm having a first end and a second end, wherein the first end of the first arm is operatively coupled to the first joint, in which the first joint is configured such that the engaging member is movable along planes that are normal to the longitudinal axis of the first arm;

a second joint operatively coupled to the second end of the first arm;

a second arm having a first end and a second end, wherein the first end of the second arm is operatively coupled to the second joint, in which the second joint is configured such that the second arm is movable along planes that are normal to the longitudinal axis of the second joint; and a coupling apparatus disposed on the second floating structure for coupling to the second end of the second arm, wherein the coupling apparatus comprises:

a hydraulic piston adapted to connect to the second end of the second arm; and a skid assembly connected to the hydraulic piston.

2. The system according to claim 1 wherein the coupling apparatus further comprises:

a third joint operatively coupled to the second end of the second arm; and a third arm having a first end and a second end, wherein the first end of the third arm has a protrusion extending into the third joint, operatively coupling the third arm to the third joint, and wherein the third joint is configured such that the third arm is rotatable about the longitudinal axis of the third arm.

3. The system according to claim 2 wherein the third joint is further configured such that the third joint is movable along planes that are normal to the longitudinal axis of the second arm.

4. The system according to claim 1 wherein the coupling apparatus further comprises:

a third joint operatively coupled to the second end of the second arm; and a third arm having a first end and a second end, wherein the first end of the third arm is operatively coupled to the third joint, and wherein the third joint is configured such that the third arm is movable along planes that are normal to the longitudinal axis of the third joint.

5. The system according to claim 4 wherein the third joint is further configured such that the third joint is movable along planes that are normal to the longitudinal axis of the second arm.

6. The system according to claim 1 wherein the receiving member further comprises:

a conical receptacle for aligning the engaging member with the receiving member.

7. The system according to claim 6 further comprising:

a plurality of male lugs provided on an interior surface of the conical receptacle; and a plurality of female lugs disposed around a circumference of the engaging member wherein each of the plurality of female lugs is engageable with each of the plurality of male lugs provided on the interior surface of the conical receptacle.

8. The system according to claim 1 wherein the receiving member moves rotatably relative to the engaging member, to engage with the engaging member.

9. The system according to claim 8 further comprising:

a motor located adjacent to the receiving member wherein, the rotational movement of the receiving member relative to the engaging member is actuatable by the motor.

10. The system according to claim 6 wherein the receiving member moves rotatably relative to the engaging member, to engage with the engaging member.

11. The system according to claim 10 further comprising:

a motor located adjacent to the receiving member wherein, the rotational movement of the receiving member relative to the engaging member is actuatable by the motor.

12. The system according to claim 1 wherein the first joint comprises:

a first section further comprising:

a first bracket that receives the first end of the first arm;

a resilient material positioned in the first bracket such that the resilient material envelops the first end of the first arm; and a first hook that is fixed to the first bracket to pivotably couple the first end of the first arm to the first bracket.

13. The system according to claim 1 wherein the second joint comprises:

a first section further comprising:

a first bracket that receives the second end of the first arm;

a second section further comprising:

a second bracket that receives the first end of the second arm;

a resilient material positioned in the second bracket such that the resilient material envelops the first end of the second arm; and a first hook that is fixed to the second bracket to pivotably couple the first end of the second arm to the second bracket.

14. The system according to claim 1 wherein the second joint comprises:

a first section further comprising:

a first bracket that receives the second end of the first arm;

a first resilient material positioned in the first bracket such that the first resilient material envelops the second end of the first arm; and a first hook that is fixed to the first bracket for coupling the second end of the first arm to the first bracket, and a second section further comprising:

a second bracket that receives the first end of the second arm;

a second resilient material positioned in the second bracket such that the second resilient material envelops the first end of the second arm; and a second hook that is fixed to the second bracket for coupling the first end of the second arm to the second bracket.

15. The system according to claim 2 wherein the third joint comprises:

a first section further comprising:

a first bracket that receives the second end of the second arm;

a second section further comprising:

a second bracket that receives the first end of the third arm wherein the protrusion extends through an opening in the second bracket and pivotably engages with the opening allowing the third arm to rotate about the longitudinal axis of the third arm; and a resilient material positioned in the second bracket such that the resilient material envelops the first end of the third arm.

16. The system according to claim 3 wherein the third joint comprises:

a first section further comprising:

a first bracket that receives the second end of the second arm;

a first resilient material positioned in the first bracket such that the first resilient material envelops the second end of the second arm; and a first hook that is fixed to the second bracket for coupling the second end of the second arm to the first bracket;

a second section further comprising:

a second bracket that receives the first end of the third arm wherein the protrusion extends through an opening in the second bracket and pivotably engages with the opening allowing the third arm to rotate about the longitudinal axis of the third arm; and a second resilient material positioned in the second bracket such that the resilient material envelops the first end of the third arm.

17. The system according to claim 4 wherein the third joint comprises:

a first section further comprising:

a first bracket that receives the second end of the second arm;

a second section further comprising:

a second bracket that receives the first end of the third arm;

a resilient material positioned in the second bracket such that the resilient material envelops the first end of the third arm; and a hook that is fixed to the second bracket for coupling the first end of the third arm to the second bracket.

18. The system according to claim 5 wherein the third joint comprises:

a first section further comprising:

a first bracket that receives the second end of the second arm;

a first resilient material positioned in the first bracket such that the first resilient material envelops the second end of the second arm; and a first hook that is fixed to the first bracket for coupling the second end of the second arm to the first bracket a second section further comprising:

a second bracket that receives the first end of the third arm;

a second resilient material positioned in the second bracket such that the second resilient material envelops the first end of the third arm; and a second hook that is fixed to the second bracket for coupling the first end of the third arm to the second bracket.

19. The system according to claim 12 wherein the resilient material comprises a flexible elastomeric element.

20. The system according to claim 13 wherein the resilient material comprises a flexible elastomeric element.

21. The system according to claim 14 wherein the first resilient material and the second resilient material comprises a flexible elastomeric element.

22. The system according to claim 15 wherein the resilient material comprises a flexible elastomeric element.

23. The system according to claim 1 wherein the hydraulic piston and the skid assembly are disposed on an extended platform on a pipe rack deck of the second floating structure.

24. The system according to claim 1 wherein the hydraulic piston and the skid assembly are disposed on a main deck of the second floating structure.

25. The system according to claim 1 wherein the hydraulic piston and the skid assembly are disposed in a box bottom of a main deck of the second floating structure.

* * * * *